United States Patent [19]

Martenson

[11] 4,166,444

[45] Sep. 4, 1979

[54] FIREPLACE FURNACE WITH HEAT EXCHANGE TUBES

[76] Inventor: Donald S. Martenson, 14935 S. Leland Rd., Beavercreek, Oreg. 97004

[21] Appl. No.: 843,986

[22] Filed: Oct. 20, 1977

[51] Int. Cl.[2] ..... F24B 1/18

[52] U.S. Cl. ..... 126/121; 126/120; 126/123

[58] Field of Search ..... 126/120, 121, 123, 124, 126/126, 138, 140

[56] References Cited

U.S. PATENT DOCUMENTS

| | | | |
|---|---|---|---|
| 1,255,493 | 2/1918 | Williams | 126/121 |
| 2,161,723 | 6/1939 | Rutland | 126/121 |
| 2,642,859 | 6/1953 | Brown | 126/121 |
| 4,015,581 | 4/1977 | Martenson | 126/121 |

*Primary Examiner*—Dennis L. Taylor

[57] ABSTRACT

A wood-burning furnace unit for insertion in an existing fireplace includes a metal firebox surrounded at its opposite sides, top and back in spaced relationship by a metal jacket to define an airspace between the jacket and firebox wall and air inlet openings into said airspace at the opposite sides of said firebox. The firebox has a front opening closed by glass doors and adjustable draft openings below such doors. Air blowers within the jacket at opposite sides of the firebox draw room air into the jacket and blow it rearwardly into heat exchange tubes which pass through the firebox from the back of the jacket airspace and discharge heated air back into the room from the front of the firebox. Baffling within the jacket distributes the room air to the various tubes. In one embodiment, there are both upper heat exchange tubes passing through an upper portion of the firebox and lower heat exchange tubes passing through a lower portion of the firebox. In a second embodiment, only the upper tubes are used.

13 Claims, 6 Drawing Figures

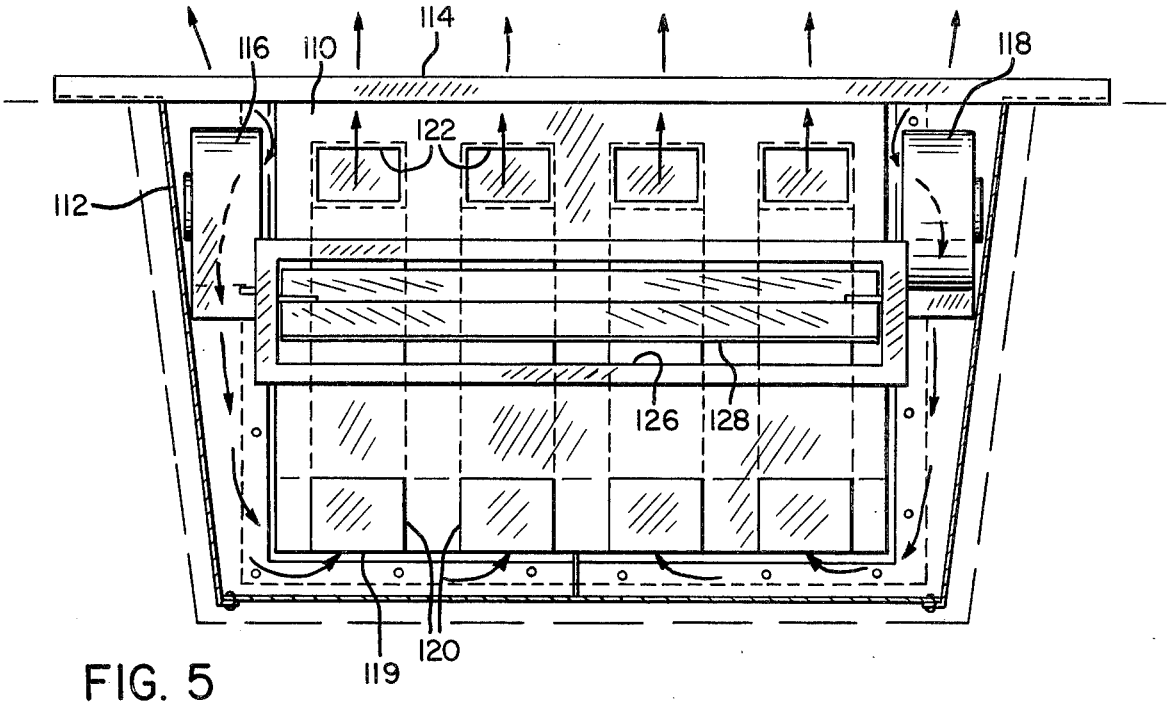
FIG. 5
FIG. 6
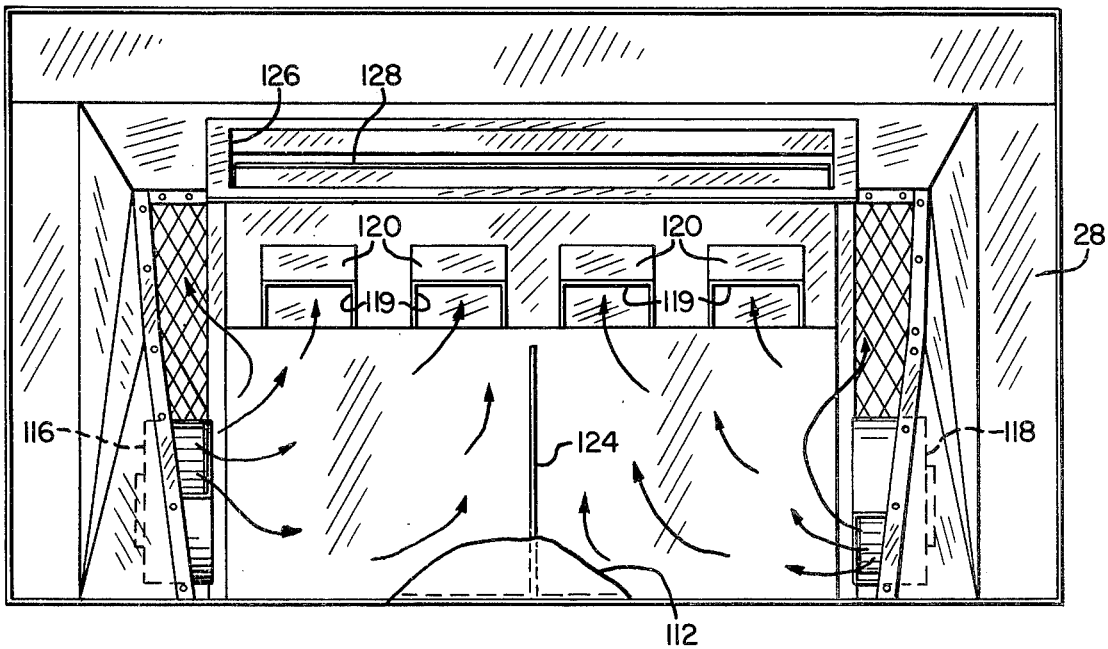

FIREPLACE FURNACE WITH HEAT EXCHANGE TUBES

BACKGROUND OF THE INVENTION

1. Field of the Invention

The present invention relates to a self-contained wood-burning furnace for insertion in an existing conventional fireplace for heating room air and recirculating such air back into the room.

2. Description of the Prior Art

Conventional fireplaces are notoriously inefficient room heaters because when used they draw warm room air into the fireplace and up the chimney.

Glass doors are commonly used to close fireplace openings to reduce the loss of warm room air through the fireplace without reducing visibility of the fire itself. Such glass doors are effective so long as there is another source of heat for the room, but they prevent the fire from radiating heat into the room.

Others have sought to solve the problem of converting a conventional fireplace to an efficient room air heater but without entire success. Many such fireplace heaters must be built into the fireplace itself, thereby requiring construction of the heater at the same time that the fireplace is built. Heaters of this type are represented by U.S. Pat. Nos. 1,706,768 and 2,165,661.

So-called fireplace heat extractors have recently become popular. Typically they comprise a system of heat exchange tubes and a blower which draws room air into the tubes and forces it back into the room. The tubes are usually placed along the back of the fireplace. Such heat extractors generally have a low air-moving capacity and therefore usually are ineffective to heat large spaces. Repesentative heat extractors are shown in U.S. Pat. Nos. 2,052,643; 2,161,723; 2,702,030; 3,240,206; 3,635,211; and 3,901,212.

The closest known prior art is my own prior U.S. Pat. No. 4,015,581, issued Apr. 5, 1977, and the prior art references cited therein. My aforementioned prior patent discloses a self-contained fireplace heater or furnace for insertion within a conventional fireplace. The heater unit includes a metal firebox within a surrounding metal jacket. Room air is drawn into side inlet openings of the jacket, then warmed by the firebox walls serving as heat exchanger surfaces, and then expelled back into the room through an upper portion of the jacket, all by natural convection. Although this heater is satisfactory to maintain warm temperatures in a room, it does require a considerable length of time to heat a cold room to a desired temperature, particularly a large room, because of the low rate of air movement through the heater by natural convection.

Others have suggested using fans to provide forced air circulation through firebox-type heaters. See, for example, U.S. Pat. Nos. 2,642,859 and 2,743,720. However, this does not entirely solve the problem because of the tendency of such fans to move air through the heater and back into the room before it can be adequately warmed because of the limited heat exchange surface area in the heater.

SUMMARY OF THE INVENTION

The present invention is an improvement of the fireplace heater disclosed in my prior U.S. Pat. No. 4,015,581. The primary objects of the present invention are to provide a fireplace heater or furnace similar to the one disclosed in my prior patent, but with improved air-heating and -circulating capacity and improved operating efficiency.

In accordance with preferred embodiments of my invention, the foregoing objects are carried out by surrounding a firebox with a jacket as before so as to provide an airspace for the circulation of room air over the outer walls of the firebox which serve as heat exchanger surfaces. However, unlike the heater of my prior patent, the present invention utilizes heat exchange tubes which extend through the firebox from inlets at the back of the jacket to outlets at a frontal portion of the firebox. In one embodiment a row of such heat exchange tubes extends through an upper portion of the firebox at an inclination from back to front. In another embodiment there are both upper heat exchange tubes as previously described and also lower heat exchange tubes extending horizontally along the floor of the firebox from back to front. Fuel, such as wood logs, can be supported directly on such lower tubes. In both embodiments air blowers are mounted within the jacket airspace at opposite sides of the firebox to circulate room air through the jacket and tubes at a high flow rate. Baffling within the jacket airspace distributes inlet airflow to the various tubes. While incoming room air is still partially heated by the heat exchange surfaces of the firebox itself, the heat exchange tubes coupled with such firebox heat exchange surfaces provide a far more efficient air heater than did the fireplace heater of my prior patent, which had no such tubes. Moreover, the use of the pair of air blowers within the jacket produces forced air circulation at a far greater rate than was provided by the natural convection heater of my prior patent, thereby providing for much more rapid heating of a room and more efficient use of fuel.

The foregoing and other objects, features, and advantages of my present invention will become more apparent from the following detailed description which proceeds with reference to the accompanying drawings.

BRIEF DESCRIPTION OF THE DRAWINGS

In the drawings:

FIG. 5 is a top plan view of a modified form of fireplace furnace in accordance with my invention with top portions of the jacket removed; and FIG. 6 is a rear elevational view of the fireplace furnace of FIG. 5 with the back wall of the jacket removed.

DETAILED DESCRIPTION OF PREFERRED EMBODIMENTS

FIG. 1 Embodiment

Figure 1:
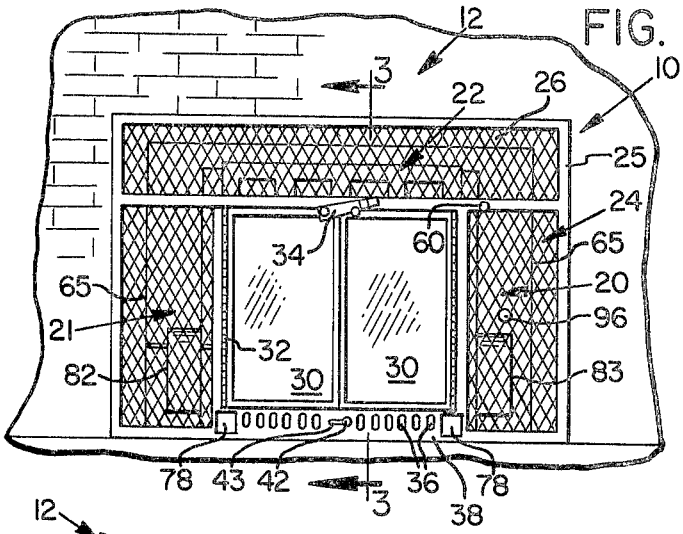
FIG. 1 is a front elevational view of a fireplace furnace in accordance with my invention installed within a fireplace.
Figure 2:
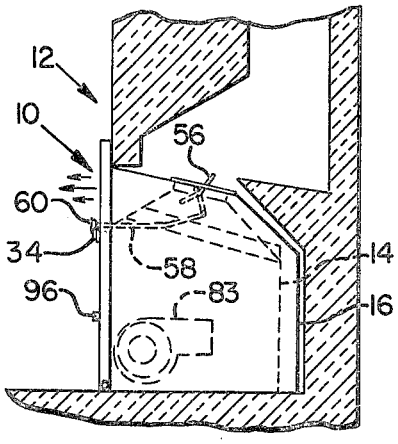
FIG. 2 is a vertical sectional view through the fireplace of FIG. 1, but not through the fireplace furnace to show the positioning of the fireplace furnace within the fireplace.
Figure 3:
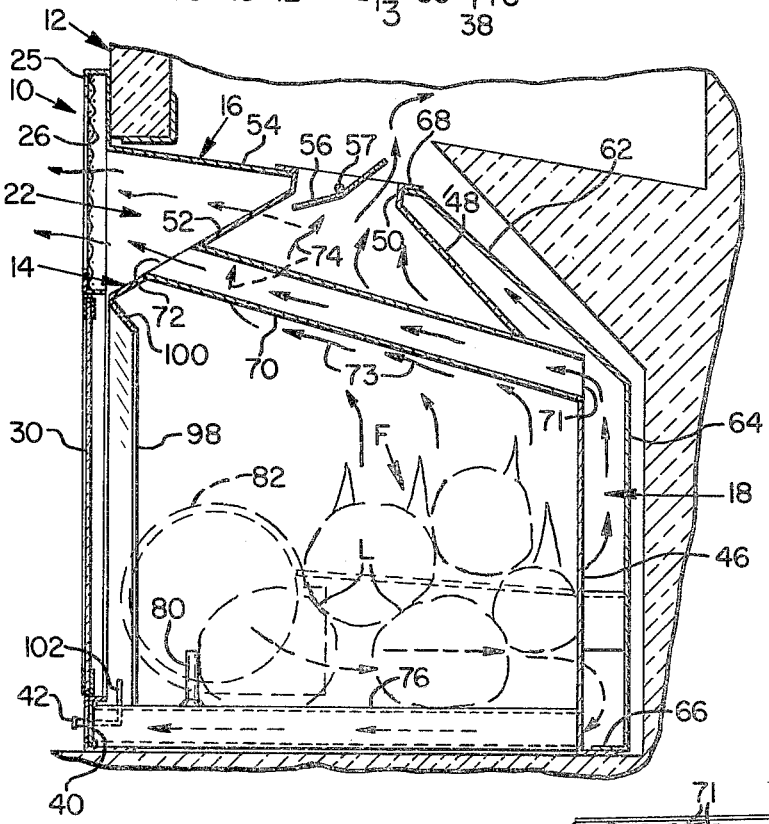
FIG. 3 is a vertical sectional view on an enlarged scale taken along the line 3—3 of FIG. 1.

Referring to the drawings, FIGS. 1–3 disclose a fireplace furnace 10 inserted somewhat like a drawer into the opening of a fireplace 12. The fireplace furnace includes a firebox 14, preferably made of heavy-gauge steel. The opposite sides, back and top of the firebox are surrounded by a sheet metal jacket 16. The walls of the jacket are spaced from the walls of the firebox to define an airspace 18 therebetween through which room air is circulated.

The fronts of both the firebox and jacket are open and substantially flush with one another at the front wall of the fireplace. The open front of the jacket defines front room air inlet openings 20, 21 at opposite sides of the firebox opening into the airspace within the jacket. The open front of the jacket above the upper wall portions of the firebox defines a warm air outlet opening 22 through which warm air from the furnace is discharged back into the room.

Figure 4:
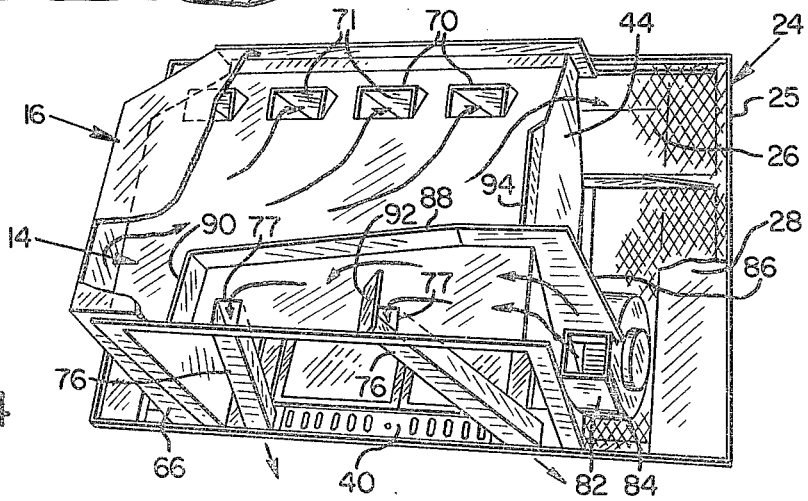
FIG. 4 is a perspective view of the fireplace furnace of FIGS. 1–3 as viewed toward the rear, bottom and one side of the furnace, but with a large portion of the outer jacket removed to reveal inner constructional details.

The front openings of the jacket are covered with a grille front 24 including a rigid grille frame 25 and grille screen 26 supported by the frame. The grille front extends from an inner margin surrounding the firebox opening to outer margins terminating outwardly beyond the outer margins of the fireplace front opening. Those portions of the grille front extending beyond the outer margins of the jacket 16 are backed by sheets of air impervious backing material 28, such as asbestos or sheet metal, as shown in FIGS. 4 and 6, to prevent room air from entering the fireplace opening around the furnace and flowing up the fireplace chimney. Thus, the furnace when installed in a fireplace forces all room air to enter either the firebox itself as draft air for the fire or the jacket for heating and recirculation into the room.

As will be evident from FIG. 1, the front opening of the firebox itself is covered by a pair of transparent tempered glass doors 30 each mounted along one side on a hinge 32 and held closed along their adjacent inner side edges by a simple door latch 34. Draft air enters the firebox through draft air openings 36 at the front of the firebox in a frame plate 38 below doors 30. The draft openings 36 are covered from behind by a slidable draft closure plate 40 (FIGS. 3 and 4) having openings therethrough at spaced intervals corresponding to the intervals of draft openings 36. Thus the openings in draft closure plate 40 can be moved into register or partial register with the draft openings 36 as desired to regulate draft airflow into the firebox simply by sliding the draft closure plate via a knob 42 extending through a horizontal slot 43 in frame plate 38.

The firebox has vertical opposite sidewalls 44 meeting a vertical backwall 46. The top wall of the firebox includes a rear top wall portion 48 pitched downwardly and rearwardly from a top exhaust opening 50 and a front top wall portion 52 pitched downwardly and forwardly from exhaust opening 50. Exhaust opening 50 extends through a top wall 54 of jacket 16 to allow for the escape of hot gases and smoke from the firebox into the fireplace flue. Exhaust opening 50 extends substantially the full width of the firebox. This is apparent from FIG. 5 which shows a second embodiment but with an exhaust opening 126 typical of both disclosed embodiments. A damper plate 56 mounted on a shaft 57 within exhaust opening 50 is operated by a lever and rod type actuating linkage means 58 shown in FIG. 2. The linkage terminates at a knob 60 at the front of the fireplace for adjusting the degree of closure of exhaust opening 50. The bottom of the firebox is open as shown in FIG. 4, thereby enabling the use of the fireplace floor on which to build a fire or to collect ashes. This feature also prevents burning out the bottom of the firebox.

Jacket 16 includes the slightly rearwardly and downwardly sloping forward top wall portion 54 and a more steeply pitched rear top wall portion 62. A generally vertical rear wall 64 joins the rear top wall portion and generally vertical opposite sidewalls 65. The jacket sidewalls slope rearwardly and inwardly to conform to the usual shape of the sidewalls of a fireplace (as shown, for example, in FIG. 5 with reference to the aforementioned second embodiment to be described later). Although the bottom of the firebox is open as previously mentioned, the bottom of the jacket is closed by a bottom wall 66, which connects the firebox to the jacket so that they are unitary. The firebox and jacket are also interconnected at flanged portions 68 surrounding the firebox exhaust opening 50.

A row of upper heat exchange tubes 70 extend through an upper portion of the firebox. Each tube 70 has an air intake opening 71 communicating with the airspace within the back of jacket 16 and a front discharge opening 72 opening into a jacket airspace 22 above the upper front of the firebox.

The upper heat exchange tubes 70 pass through the firebox at an inclination from back to front thereof and are of rectangular cross section with a flat bottom surface facing downwardly toward the fire F within the firebox. Thus hot smoke and gases from fire F heat the tubes 70 and flow upwardly and forwardly along such tubes, as shown by arrows 73 in FIG. 3, before passing about such tubes and out through exhaust opening 50 into the fireplace flue, as shown by arrows 74. In the embodiment shown there are four upper tubes spaced apart horizontally across the upper portion of the firebox through substantially its entire width, although any number of such tubes could be provided, including, if desired, other rows of tubes above or below the row of tubes 70. Tubes 70, heated directly by hot gases and smoke from fire F, heat air passing therethrough from back to front of the firebox. The heated air passes from tube outlets 72 into jacket air outlet 22 and through grille screen 26 back into the room in which the fireplace is situated.

A second, lower pair of heat exchange tubes 76 extends through the bottom of the firebox horizontally from back to front. Such lower tubes include intake openings 77 (FIG. 4) in communication with the airspace within the back of jacket 16 and discharge openings 78 (FIG. 1) passing through frame plate 38 at the front of the firebox. The pair of lower tubes 76 are of rectangular cross section and are sufficiently close together to support logs L. A peg-type stop 80 is welded to the upper surface of each heat exchange tube 76 near its forward end to prevent logs L from rolling forwardly against glass doors 30.

A pair of electric motor-operated air blowers 82, 83 is mounted within airspace 18 of jacket 16, one on each of the opposite sides of the firebox, just inwardly of air inlet openings 20, 21. The air intake for each blower is positioned adjacent to the firebox wall (see FIG. 5) whereas the air discharge opening 84 of each blower is directed rearwardly to blow air toward the back of the jacket.

As shown best in FIG. 4, one side and the back of the jacket airspace 18 are baffled by a generally horizontally extending side baffle 86 joining a generally horizontally extending back baffle 88. Baffle 88 extends across the back of the firebox and joins a generally vertical baffle 90 near the side of the firebox opposite side baffle 86. Side baffle 86 extends rearwardly from a juncture with blower 82 just above its discharge opening 84. Back baffle 88 extends across the back of the firebox between air inlets 77 for the lower heat exchange tubes 76, and air inlets 71 for the upper heat exchange tubes 70. These baffles also extend the full width of the jacket airspace from the firebox wall to the jacket wall, thereby effectively directing all discharge air from blower 82 to the inlets for the lower heat exchange tube 76. A short upright deflection baffle 92 on the downstream side of the upstream air inlet 77 deflects at least a portion of the airflow from blower 82 into the upstream heat exchange tube 76, thereby ensuring that there will be substantially equal airflow through both of lower tubes 76.

The airspace on the opposite side of the jacket containing blower 83 is unbaffled. Therefore all air discharged from blower 83 rearwardly into the jacket airspace is directed into the inlets 71 for the upper heat exchange tubes 70.

A vertical corner baffle 94 joins the back baffle 88 at its intersection with side baffle 86 and extends upwardly therefrom to direct any airflow from blower 83 bypassing upper tube inlets 71 back into the room through the upper portions of the jacket airspace and grille front 24. Also such corner baffle causes any room air entering the jacket airspace along the sides of the firebox and bypassing blower 82 to pass rearwardly around the fan and into the heat exchange tubes 77 below baffles 86 and 88.

The operation of both blowers 82, 83 is controlled by a common control knob 96 mounted at grille front 24. Knob 96 can be either a simple on-off switch control, or, if desired, it can be a rheostat-type switch control for controlling the speed of the blowers.

The interior of firebox 14 is baffled to deflect heat and smoke away from glass doors 30 and concentrate them along the walls of the firebox which serve as heat exchange surfaces. As shown best in FIG. 3, the interior baffling includes vertically extending side baffles 98 at opposite front corners of the firebox to direct heat along the opposite sidewalls of the firebox and away from the front glass. The baffling also includes a top baffle 100 extending inwardly and downwardly from the intersection of top wall 52 with the front of the firebox. The top baffle deflects heat and smoke away from the glass doors and upwardly toward the heat exchange tubes 70 and top wall 52. The baffling may also include a bottom baffle 102 extending along the front of the firebox below glass doors 30 on damper plate 40 as shown in FIG. 3 to divert an upper portion of the incoming draft airflow upwardly over the inside surface of the glass doors while a lower portion of the draft airflow bypasses the baffle and flows directly toward the fire F. Baffle 102 thus provides an air curtain over the inside of the glass doors to help maintain such doors free of smoke.

Operation of FIG. 1 Embodiment

The operation of the FIG. 1 embodiment will be readily apparent from the foregoing description, with reference to FIGS. 1–4. However, summarizing such operation, a fire is built within firebox 14 with logs L or other material supported on the lower heat exchange tubes 76 rearwardly of stop pegs 80. The draft control knob 42 is moved to open draft openings 36. Damper control handle 60 is adjusted to maintain damper plate 56 in a slightly open position so that exhaust gases and smoke can escape upwardly into the fireplace flue.

With the fire burning satisfactorily, the glass doors 30 are closed by latch 34, and blowers 82, 83 are turned on using control knob 96. The blowers and natural convection cause room air to enter the airspace of the jacket 16 along opposite sides of the firebox. A large portion of this air enters the blower air intakes to be discharged rearwardly at high velocity. As soon as the room air enters the jacket airspace, the hot walls of the firebox and radiation from such walls begin to warm it. Air moving rearwardly along the walls of the firebox turns the corner at the rear of the firebox to pass along its rear wall where the air continues to be heated. Air from blower 82 flows rearwardly below baffling 86, 88 and 90 where it eventually enters the lower heat exchange tubes 76 which, being heated directly by the fire within the firebox heats the air passing therethrough before such air is forced out of front tube outlets 78 back into the room.

Air passing rearwardly from blower 83 passes along the back wall of the firebox above baffling 88, 90 where most of it enters air inlets 71 of upper heat exchange tubes 70. However, before entering such tubes the air is already heated substantially by the firebox walls. Once within the upper tubes 70 the air continues to be heated, since the tubes are heated by the hot smoke and gases rising from the fire within the firebox. Air passes forwardly through the tubes and is discharged from their front openings 72 into the upper front portion of the jacket 16 and then back into the room through the upper grille front 24.

Any room air flowing into the jacket but not entering either the upper or lower tubes will nevertheless be heated substantially by the walls of the firebox before passing upwardly and back out into the room through the upper portion of the grille front 24.

Some of the hot smoke and gases within the firebox pass upwardly and then forwardly along the bottoms of upper tubes 70 and then upwardly about such tubes before being discharged into the fireplace chimney through exhaust opening 50. Hot smoke and gases within the firebox are also concentrated along the sidewalls and top wall of the firebox by side baffles 98 and top baffle 100. The damper opening and draft openings of the firebox can be adjusted to provide a desired rate of burning and to maintain the glass doors free of smoke.

FIG. 5 Embodiment

FIGS. 5 and 6 show a modified form of the fireplace furnace of FIGS. 1–4. The fireplace furnace of FIGS. 5 and 6 is similar in most respects to the fireplace furnace of FIGS. 1–4 in that it includes a similar firebox 110, surrounding jacket 112 and grille front 114, with glass doors (not shown) closing the front opening of the firebox. Similarly, blowers 116, 118 are mounted within the opposite sides of the jacket adjacent to the jacket air inlets in a manner similar to that described with respect to FIGS. 1–4.

The one essential difference between the fireplace furnace of FIGS. 5 and 6 and that of FIGS. 1–4 is that the former eliminates the lower heat exchange tubes 76. Thus the need for the generally horizontally extending side baffling 86 and back baffling 88, 90, as shown in FIG. 4, is eliminated in the embodiment shown in FIGS. 5 and 6. Instead, both blowers 116, 118 of the FIG. 5 embodiment blow room air rearwardly within the jacket to air inlets 119 of four upper heat exchange tubes 120 which extend through the upper portion of the firebox 110 in the same manner as previously described with respect to the FIG. 1 embodiment. Heat exchange tubes 120 are inclined in a direction from back to front of the firebox and discharge air into the upper front of the jacket and through the upper grille front 114 from air outlet openings 122. A vertical baffle 124 midway along the back of the firebox divides airflow from the blowers so that airflow from the left blower 116 as viewed in FIG. 6 enters the two left-hand heat exchange tubes 120 whereas flow from the right-hand blower 118 enters the two right-hand heat exchange tubes 120.

Firebox 110, like the firebox of the FIG. 1 embodiment, includes an exhaust opening 126 extending substantially the full width of the top of the firebox and a damper plate 128 for regulating the degree of closure of damper opening 126.

Except as specifically described, the operation of the FIG. 5 embodiment is the same as the operation of the FIG. 1 embodiment.

Other modifications of the fireplace furnace disclosed could be made if desired for cost reduction, or if the high rate of airflow as produced by the illustrated embodiments is not required for a given application. For example, use of the blowers 82, 83 could be eliminated altogether so that natural convection is relied upon entirely to produce the heat exchange effect and flow through the heat exchange tubes. Also, the capacity of the fireplace furnace and heat exchange efficiency of the furnace could be increased by increasing the number of heat exchange tubes extending through the firebox. For example, a larger or smaller number of upper or lower heat exchange tubes than that shown could be used depending on the size of the firebox, which in turn depends upon the size of the fireplace itself.

Having illustrated and described the principles of my invention from what are presently preferred embodiments, it should be apparent to those skilled in the art that other modifications can be made without departing from such principles. I claim as my invention all such modifications as come within the true spirit and scope of the following claims.

I claim:

1. A wood-burning furnace for insertion as a unit in an existing fireplace comprising:

a firebox, a jacket encompassing and spaced from the opposite sides and back of said firebox to define an airspace between said firebox and jacket and air inlet openings into said airspace between frontal side portions of said jacket and firebox, said firebox walls comprising heat exchange surfaces for heating air passing through said airspace, and multiple heat exchange tubes passing through said firebox from air intake openings communicating with said airspace at the rear of said firebox to air discharge openings communicating with ambient air at a frontal portion of said firebox.

2. Apparatus according to claim 1 wherein said tubes include multiple upper tubes passing through an upper portion of said firebox.

3. Apparatus according to claim 2 wherein said upper tubes extend at an inclination through said firebox upwardly from back to front thereof;

said upper tubes being arrayed in a single row laterally across said upper portion; and each of said upper tubes having a flat bottom wall;

whereby air in said tubes flows convectively through said firebox from back to front thereof when said tubes are heated, and hot gases rising from a fire in said firebox are conducted forwardly along the bottoms of said tubes rather than flowing directly upward and out the chimney.

4. Apparatus according to claim 3 including a vertically extending flow-dividing baffle means positioned across said airspace at the back of said firebox for distributing incoming airflow from the air inlet at one side of said firebox to approximately one-half of said tubes and the incoming airflow from the air inlet at the other side of said firebox to the other approximately one-half of said tubes.

5. Apparatus according to claim 1 including a pair of air blower means positioned within said airspace, one at each of the opposite sides of said firebox just inwardly of said air inlet openings in a manner so as to induce room airflow into said air inlet openings and expel said air rearwardly in said airspace at opposite sides of said firebox.

6. Apparatus according to claim 1 wherein said multiple heat exchange tubes include multiple upper tubes passing through an upper portion of said firebox and at least two lower tubes passing through said firebox along a lower portion thereof, said lower tubes extending from back to front of said firebox so as to support burnable materials placed thereon.

7. Apparatus according to claim 6 including baffle means within said airspace and extending between said firebox walls and said jacket walls for directing a portion of the incoming airflow from said air inlet opening on one side of said firebox to said upper tubes and another portion of the incoming airflow from said opening on the opposite side of said firebox to said lower tubes.

8. Apparatus according to claim 7 including a pair of air blower means positioned within said airspace, one at each of the opposite sides of said firebox just inwardly of said air inlet openings so as to induce the flow of room air into said air inlet openings into said airspace and expel said air rearwardly into said airspace along opposite sides of said firebox, said baffle means including a generally horizontal baffle member extending between said firebox wall and said jacket wall along one side and a portion of the back of said firebox above said lower tubes, and a generally vertical baffle member extending between said walls from the bottom of said airspace to meet said generally horizontal member, said vertical and horizontal members cooperating to enclose a portion of said airspace which communicates at the rear of said firebox with said lower tubes;

whereby air discharged from one of said blowers is directed rearwardly toward the back of said firebox and into the air intake openings of said lower tubes, the same said baffle means serving to direct air discharged from the other said blower means rearwardly into said airspace and into the intake openings of said upper tubes.

9. Apparatus according to claim 1 including transparent glass closure means closing a front opening of said firebox, draft opening means below said glass closure means at the front of said firebox for admitting a limited flow of room air into said firebox, and adjustable draft closure means for said draft openings, said firebox including an upper wall means defining an exhaust gas opening for discharge of smoke and gases into a flue of the fireplace in which said furnace is installed, adjustable damper means mounted within said exhaust opening and damper-operating means operable from a frontal portion of said furnace for adjusting the degree of closure of said exhaust opening.

10. Apparatus according to claim 1 wherein:

upper wall means above said heat exchange tubes, has an exhaust opening for exhausting rising smoke and gases from said firebox; and said jacket also encompasses said upper wall means to define an extension of said airspace.

11. Apparatus according to claim 10 wherein:

said upper wall means includes a rear upper wall portion pitched downwardly and rearwardly from said exhaust opening and a forward upper wall portion pitched downwardly and forwardly from the exhaust opening of said firebox;

said multiple heat exchange tubes include a row of multiple upper tubes extending through an upper portion of said firebox from air intake openings at the base of said rear upper wall portion to outlet openings in a lower portion of said forward upper wall portion, said row of upper tubes extending in spaced-apart relationship substantially from side to side of said firebox and at an upward inclination from back to front thereof, said upper tubes being of rectangular cross section and having flat bottom walls directed toward the bottom of said firebox;

said exhaust opening extending substantially from side to side of said firebox and being positioned so as to overlie intermediate portions of said upper tubes;

whereby hot smoke and gases produced within said firebox are induced to flow generally upwardly and forwardly along said tubes before passing upwardly about said tubes and then upwardly along said forward and rearward upper wall portions, heating the air in contact therewith, before passing out through said exhaust opening.

12. Apparatus according to claim 11 wherein:

said multiple heat exchange tubes include at least two lower tubes extending generally horizontally through the bottom of said firebox from air intake openings at the bottom of said airspace to discharge openings at the front of said firebox, said lower tubes serving as supports for logs placed in said firebox and as heat exchangers to extract heat from burning materials near the bottom of said firebox; and said apparatus further includes air blower means and baffle means positioned within said airspace between said firebox and said jacket walls;

said baffle means including a first baffle means extending from one of said frontal side air inlet openings along a side and at least a portion of the rear of said firebox and enclosing a portion of said airspace which communicates at the rear of said firebox with said lower tubes and at the front of said firebox with said air inlet openings;

said baffle means including second baffle means for diverting air flowing in said airspace into air intake openings in said multiple tubes, thereby tending to equalize the volume of air flowing through said tubes; and one of said air blower means being mounted beneath said first baffle means at the front of said airspace;

whereby, when said fireplace is operated, air entering said airspace on one side of said firebox flows to the back of said firebox and downwardly through said lower tubes, and air entering said airspace on the opposite side flows to the back of said firebox and upwardly through said upper tubes, said air being first heated by contact with said firebox and then being further heated by contact with said tubes.

13. Apparatus according to claim 11 including side baffle means within said firebox and extending generally vertically along opposite sides of the firebox front opening to baffle smoke and heat away from said front opening and toward opposite sidewalls of said firebox; and top baffle means within said firebox extending generally horizontally above the top of said front opening so as to direct hot gases and smoke within said firebox toward said heat exchange tubes and upper wall portions of said firebox.

* * * * *